United States Patent [19]

Tseronakis

[11] Patent Number: 4,594,740

[45] Date of Patent: Jun. 17, 1986

[54] SINK TRAP ASSEMBLY

[76] Inventor: Antoine Tseronakis, 165 Morton Way, Brampton, Ontario, Canada, L6Y 2P7

[21] Appl. No.: 682,960

[22] Filed: Dec. 18, 1984

[51] Int. Cl.[4] ..... E03C 1/26; F16K 13/00

[52] U.S. Cl. ..... 4/288; 137/247.35; 137/247.51

[58] Field of Search ..... 4/191, 197, 206, 207, 4/DIG. 7, 286–292; 137/247–247.51

[56] References Cited

U.S. PATENT DOCUMENTS 4,263,138 4/1981 Kessel ..... 137/247.45 X

FOREIGN PATENT DOCUMENTS 302846 6/1918 Fed. Rep. of Germany ..... 137/247.35
785952 4/1935 France ..... 137/247.35
998057 1/1952 France ..... 137/247.35
1190383 12/1959 France ..... 4/288
2070093 9/1981 United Kingdom ..... 4/191

*Primary Examiner*—Charles E. Phillips
*Attorney, Agent, or Firm*—Robert F. Delbridge; Arne I. Fors

[57] ABSTRACT

A sink trap assembly includes an upper vertical tubular part having a side wall with a tubular outlet securable to a horizontal outlet pipe. The upper part also has an open upper end and a lower open end to enable the tubular part to be installed by upward movement to position the upper end in sealing engagement with a lower surface of a sink around a strainer with the outlet of the tubular part being directed in any desired horizontal direction. The sink trap assembly also includes a lower part sealingly engageable with a lower end of a tubular part to close the lower open end thereof. At least one of the parts is secured to the strainer to retain the trap assembly in position.

1 Claim, 5 Drawing Figures

SINK TRAP ASSEMBLY

This invention relates to sink trap assemblies.

Because conventional sink trap assemblies of U-shape occupy an undesirably large area below a sink, attempts have been made to provide satisfactory sink trap assemblies of relatively short vertical heighnt. However, for one reason or another, prior sink trap assemblies of this kind have not become particularly successful.

It is therefore an object of the invention to provide an improved sink trap assembly which occupies a relatively short vertical height.

According to the invention, a sink trap assembly comprises an upper vertical tubular part having a side wall with a tubular outlet securable to a horizontal outlet pipe and an open upper end and a lower open end to enable the tubular part to be installed by upward movement to position the upper end in sealing engagement with a lower surface of a sink around a strainer with the outlet of the tubular part being directed in any desired horizontal direction, and a lower part sealingly engagable with a lower end of a tubular part to close the lower open end thereof, at least one of said parts being secured to the strainer to retain the trap assembly in position.

Thus, with a sink trap assembly in accordance with the invention, the horizontal outlet of the upper tubular part can be oriented in any desired direction for attachment to a horizontal outlet pipe. Further, a sink trap assembly in accordance with the invention comprises only two parts which are easily securable to a convention sink and strainer.

The lower part may have a central upstanding portion with an internal screw thread securable to an external screw thread on a lower end of a strainer to cause sealing engagement between the upper end of a tubular part and a lower surface of a sink and between the lower end of the tubular part and the lower part.

Alternatively, the upper end of the upper tubular part may have inwardly directed securing means positionable between a lower surface of the sink and an outwardly directed flange on a lower portion of a strainer to retain the tubular part in sealing engagement with the lower surface of the sink, the lower parts being securable to the lower end of the tubular part.

The upper tubular part and lower parts may conveniently be made as plastic moldings, but may alternatively be of metal if desired.

Figure 1:
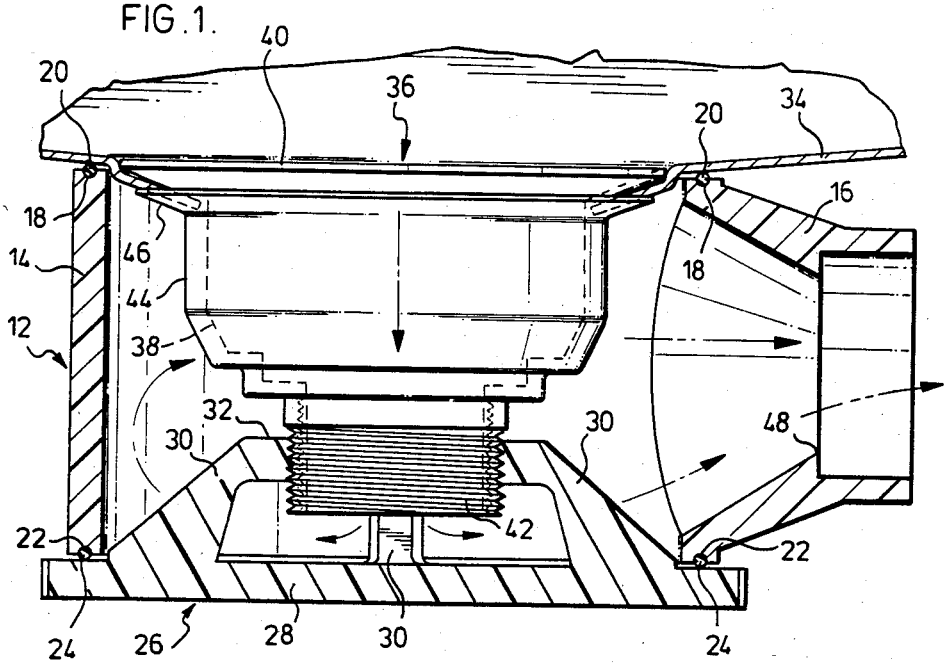
Figure 2:
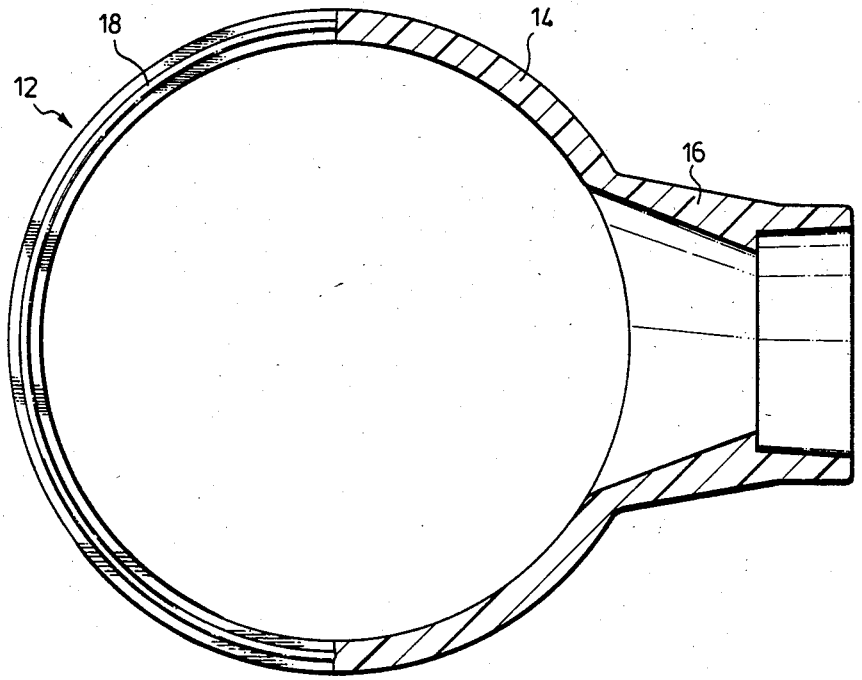
Figure 3:
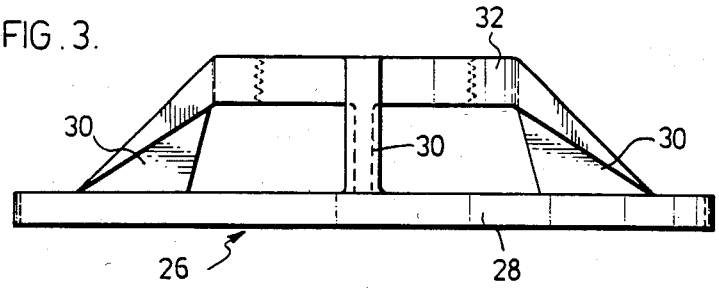
Figure 4:
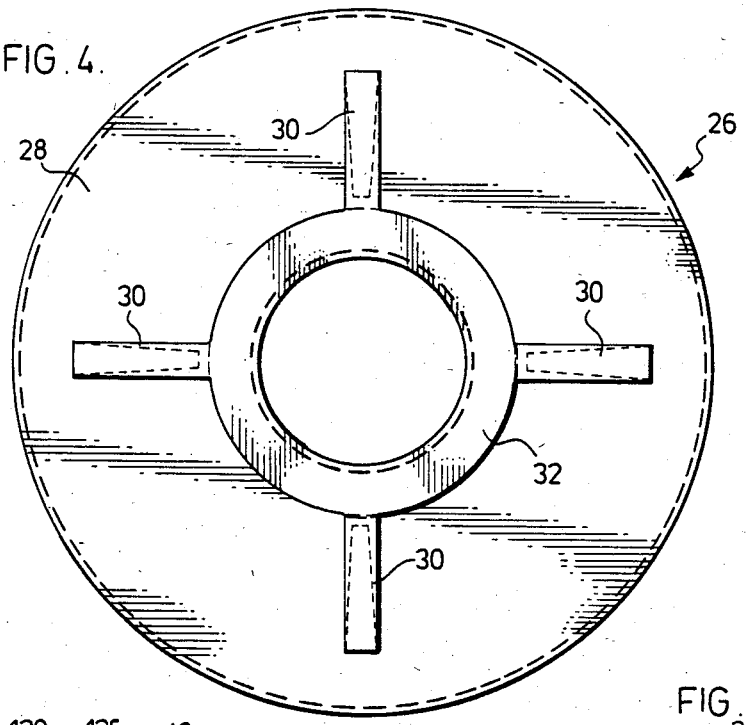
Figure 5:
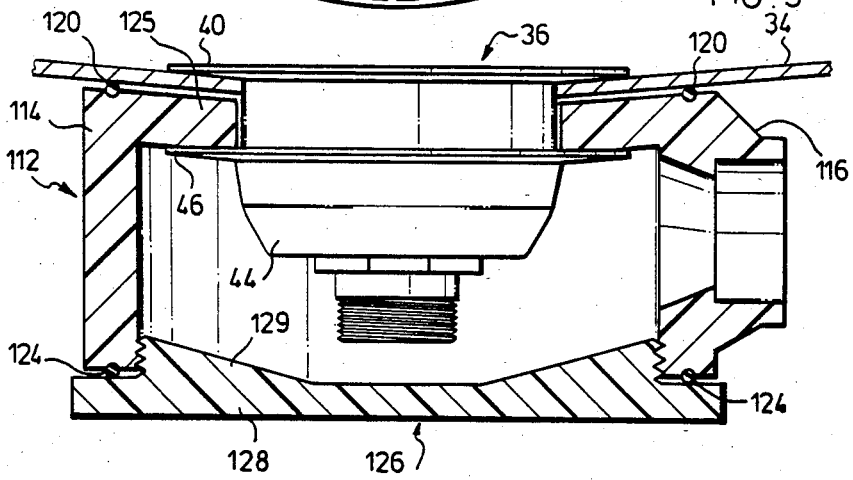

One embodiment of the invention will now be described, by way of example, with reference to the accompanying drawings, of which;

FIG. 1 is a vertical sectional view of a sink trap assembly in accordance with one embodiment of the invention, FIG. 2 is a plan view, partly in section, of the upper tubular part of the sink trap assembly, FIG. 3 is a side view of the lower part of the sink trap assembly, FIG. 4 is a plan view of the lower part, and FIG. 5 is a vertical sectional view of a sink trap assembly in accordance with a second embodiment.

Referring first to FIGS. 1 to 4 of the drawings, a sink trap assembly comprises an upper vertical tubular part 12 formed as a molding of suitable plastic. The tubular part 12 has a side wall 14 with a lateral outlet in the form of an integral spigot 16 securable to a horizontal outlet pipe (not shown). The upper end of the side wall 14 has a recess 18 containing a sealing ring 20, and the lower end of the side wall 14 has a recess 22 containing a sealing ring 24.

The sink trap assembly also comprises a lower part 26 also formed as a molding of suitable plastic. The lower part 26 has a circular base 28 with a central upstanding portion having four equal-angularly spaced arms 30 supporting a retaining ring 32 which is internally screw-threaded.

The sink trap assembly can be readily fitted to a sink 34 with a conventional strainer 36, such a strainer having an inner portion 38 with an outwardly directed flange 40 at its upper end and an external screw thread on its lower projecting end 42, the strainer also having an outer portion 44 with an outwardly directed flange 46 at its upper end. The strainer 36 is fitted in the central opening in the sink with the flange 40 of a inner portion 38 engaging the upper surface of the sink 34 around its central opening and the flange 46 of the outer portion 44 engaging the lower surface of the sink around its central opening. The lower end of the outer strainer portion 44 is internally screw-threaded and is screwed onto the lower end 42 of the inner strainer portion 36 to cause the portion of the sink 34 around its central opening to be securely held between the flanges 40, 46 of the strainer 36.

To install the sink trap assembly in accordance with the invention, the upper tubular part 12 is moved upwardly from below to position its upper end with sealing ring 20 in sealing engagement with the lower surface of sink 34 around the strainer 36 with the outlet spigot 16 being directed in any desired horizontal direction. The lower part 26 is then screwed onto the lower end 42 of the strainer 36 to cause the base 28 to seal against the lower end and sealing ring 22 of the tubular part 14. The lower part 26 is tightened in this manner to ensure good sealing engagement between the tubular part 14 and the sink 34 and between the tubular part 14 and the lower part 26.

Ease of installation and removal (such as for cleaning) of the sink trap assembly can readily be appreciated. It will also be readily apparent to a person skilled in the art that the necessary depth of water retained in the sink trap assembly to cover the lower end 42 of the strainer 36 is determined by the greatest height of the bottom of the outlet passage in the spigot 16, namely the point 48 in FIG. 1. The short vertical height of the sink trap assembly will also be readily appreciated.

FIG. 4 shows an alternative embodiment in which the upper tubular part 112 has a side wall 114 with a lateral outlet in the form of spigot 116 as well as upper and lower sealing rings 120 and 124. The tubular part 112 has an inwardly directed flange 125 at its upper end which is retained between the lower surface of the sink 34 and the flange 46 of the outer strainer portion 44, thereby causing the sealing ring 120 to sealingly engage the lower surface of the sink 34. As clearly indicated in FIG. 4, the lower open end of the tubular part 112 is larger than the outwardly directed flange 46 of the outer strainer portion 44 to enable the outer strainer portion 44 to be engaged with the inner strainer portion by upward movement through the lower open end of the tubular part 112. The lower end of the tubular part 112 is internally threaded and receives an external thread on an upstanding annular projection 129 on the base 128 of the lower part 126.

After securing the tubular part 112 in place in the manner indicated above, the lower part 126 is screwed into the lower end of the tubular part 112 to seal against the sealing ring 124, thereby closing the base of the tubular part 112. Again, the advantages of this embodiment will be clear to a person skilled in the art.

Other embodiments of the invention will also be readily apparent to a person skilled in the art, the scope of the invention being defined in the appended claims.

What I claim as new and desire to protect by Letters Patent of the United States is:

1. A sink trap assembly comprising a strainer having a tubular inner portion with an outwardly directed flange at an upper end and an external screw thread on a lower end, said strainer also having a tubular outer portion with an outwardly directed flange at an upper end and an internal screw thread at a lower end, the tubular inner portion of the strainer being fittable in a sink opening with the outwardly directed flange of the tubular inner portion engaging an upper surface of the sink and with the lower end of the tubular inner portion projecting downwardly through the sink opening, and the tubular outer portion being screwable onto the lower end of the tubular inner portion beneath the sink, said sink trap assembly also comprising an upper vertical tubular part having a side wall with a tubular outlet securable to a horizontal outlet pipe, an open upper end, and a lower open end to enable the upper tubular part to be installed by upward movement to position the upper end in sealing engagement with a lower surface of a sink around the inner strainer portion with the outlet of the tubular part being directed in any desired horizontal direction, the upper end of the upper tubular part having an inwardly directed flange positionable between the lower surface of the sink and the outwardly directed flange on the outer portion of the strainer, when the outer strainer portion is screwed onto the inner strainer portion beneath the sink, to retain the tubular part in sealing engagement with the lower surface of the sink, the lower open end of the tubular part being larger than the outwardly directed flange of the outer strainer portion to enable the outer strainer portion to be engaged with the inner strainer portion by upward movement through the lower open end of the tubular part, and a lower part sealingly engageable with the lower open end of the upper tubular part to close said lower open end, the lower part and the lower end of the tubular part having cooperating screw thread means to enable the lower part to be detachably secured to the lower end of the tubular part.

* * * * *